United States Patent [19]

Audeh

[11] 4,390,409

[45] Jun. 28, 1983

[54] CO-PROCESSING OF RESIDUAL OIL AND COAL

[75] Inventor: Costandi A. Audeh, Princeton, N.J.

[73] Assignee: Mobil Oil Corporation, New York, N.Y.

[21] Appl. No.: 271,054

[22] Filed: Jun. 5, 1981

[51] Int. Cl.[3] ..... C10G 1/00; C10G 17/00

[52] U.S. Cl. ..... 208/8 LE; 208/251 R

[58] Field of Search ..... 208/8 LE, 251 R

[56] References Cited

U.S. PATENT DOCUMENTS

| | | | |
|---|---|---|---|
| 3,705,092 | 12/1972 | Gatsis | 208/8 LE |
| 3,870,621 | 3/1975 | Arnold et al. | 208/8 LE |
| 3,966,585 | 6/1976 | Gray et al. | 208/8 LE |
| 4,040,941 | 8/1977 | Yamada et al. | 208/8 LE |
| 4,054,504 | 10/1977 | Cherverak et al. | 208/10 |
| 4,108,758 | 8/1978 | Schoennagel et al. | 208/8 LE |
| 4,111,786 | 9/1978 | Sugimura et al. | 208/8 LE |

*Primary Examiner*—Delbert E. Gantz
*Assistant Examiner*—William G. Wright
*Attorney, Agent, or Firm*—C. A. Huggett; C. J. Speciale; L. G. Wise

[57] ABSTRACT

Coal and metals-containing residual oil are coprocessed under conditions whereby the coal is volatilized and solubilized, the residual oil is demetallized and substantially no coking of the residual oil occurs. The products obtained include metals-free distillates and metals-containing solid fuel.

13 Claims, 1 Drawing Figure

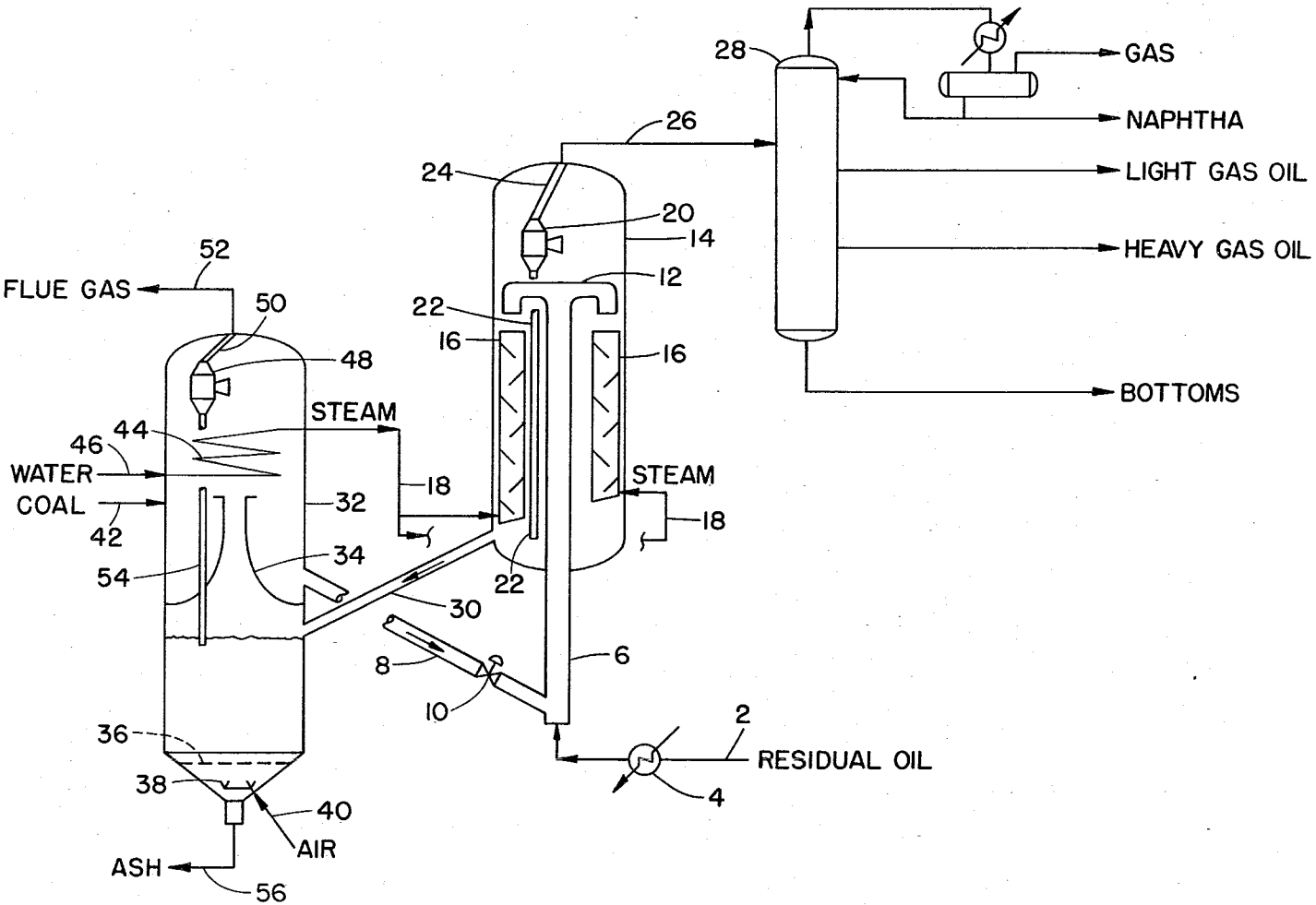
GAS
NAPHTHA
LIGHT GAS OIL
HEAVY GAS OIL
BOTTOMS
RESIDUAL OIL
STEAM
STEAM
AIR
FLUE GAS
WATER
COAL
ASH
2
4
6
8
10
12
14
16
18
20
22
24
26
28
30
32
34
36
38
40
42
44
46
48
50
52
54
56

CO-PROCESSING OF RESIDUAL OIL AND COAL

BACKGROUND OF THE INVENTION

1. Field of the Invention

This invention relates to the co-processing of residual oil and coal. More particularly, it relates to a process for the volatilization and solubilization of coal and the demetallization of residual oil. This invention especially relates to the processing of residual oil and coal to provide metals-free distillates and a metals-containing solid fuel.

2. Description of the Prior Art

Petroleum has been utilized heretofore as a major source of energy, particularly because of its relatively low cost and its availability in liquid form which permitted ease of transportation and ultimate use. This relatively clean burning energy source presents a minimum of disposal problems and thus has found wide-spread use throughout the world. Natural gas is a fuel which has also been utilized as a particularly useful form of energy but its gaseous form has limited its transportability and hence it has not found the world-wide use that petroleum has. Recent economic and political developments have led to increasingly high purchase prices for both of these products. In addition, the high cost of energy from petroleum and natural gas as well as their potentially limited availability has led to investigation of alternate sources of energy such as oil shale and tar sands. There has recently been an increased interest in coal as a major energy source. Reserves of coal are far greater than the known reserves of all other mineral fuels (petroleum, natural gas, oil shade and tar sands) combined. Since coal is a solid fuel and when burned in this form requires disposition of residual ash, its use as a major energy source is not as desirable as either petroleum or natural gas. However, processes have been and are being developed to convert coal into both liquified and gaseous fuels which will increase its desirability as a useful energy source. Although these conversion processes have not proven economical heretofore, the increasing cost of conventional energy sources make these conversion techniques more and more attractive.

Coal liquefaction and gasification processes developed heretofore utilize a wide variety of techniques including thermal and catalytic conversion, non-hydrogenative and hydrogenative conversion and various combinations thereof. Patent art in this area includes the following: U.S. Pat. No. 3,870,621 of Arnold, et al. discloses contacting a liquid phase of a petroleum residual oil with finely divided coal in a fixed or moving bed at a temperature in the range of 700°-900° F. to produce cracked products from the oil and hydrocarbons from the coal which are fractionated to produce a heavy recycle stream and lighter products. The solid char recovered as a product from the contacting zone can find use as a high quality solid fuel.

U.S. Pat. No. 4,108,758 of Schoennagel, et al. discloses a process for obtaining liquid fuels from coal which involves the solubilizing of coal in a fluid catalytic cracked residual oil to form a solvated coal solution phase and an ash solid phase. The two phase admixture is fluid catalytically cracked in the presence of a zeolite cracking catalyst to produce a hydrocarbon phase and a catalyst-ash solids phase. The catalyst-ash solids phase is treated in a catalyst regeneration zone whereby entrained ash solids are removed from the flue gas effluent from the catalyst regenerator.

Although most of prior art coal conversion processes employ hydrogen, Arnold, et al. and Schoennagel, et al. do not employ added hydrogen in the conversion step. In Arnold, et al. the heavy feed is essentially catalytically cracked, utilizing solid sub-bituminous or lower rank coal particles as the catalyst under temperature conditions of 700°-900° F., a pressure between 10 and 100 psig and a space velocity of 0.1 to 3.0 lbs. of oil per hour per pound of coal. The liquid product is fractionated to a light fraction recovered as the product with the higher boiling fraction recycled to the contacting zone. A solid char is withdrawn from the bed of coal and is utilized as solid fuel. In Schoennagel, et al. a mixture of residual oil and coal is admixed with gas oil and introduced into a conventional catalytic cracking reactor to produce the conventional liquid products obtained in catalytic cracking. The ash from the coal is recovered in the gaseous effluent from the regenerator vessel.

It is an object of this invention to provide a process for converting mixtures of petroleum residua and coal to useful products.

It is another object of this invention to provide a process for the volatilization and solubilization of coal and the demetallization of residual oil from residual oils co-processed with coal.

It is a further object of this invention to convert petroleum residual oil and coal to products including metals-free distillate and metals-containing solid fuel.

SUMMARY OF THE INVENTION

In accordance with the present invention, it has been found that coal and petroleum residual oil can be co-processed under conditions which are effective to provide metals-free distillates and metals-containing solid fuel. More particularly, it has been found that a mixture of coal and petroleum residuum can be subjected to temperatures above about 850° F. to effect volatilization and solubilization of the coal and demetallization of the residual oil.

One embodiment of the process of this invention is described as a process for the volatilization and solubilization of coal and the demetallization of residual oil which comprises:

(a) providing coal at a temperature of about 650° to about 750° F. and a metals containing residual oil at a temperature of about 900° to about 950° F. but below the incipient coking temperature of said residual oil to a processing zone maintained under conditions effective to volatilize and solubilize said coal, demetallize said residual oil and substantially prevent coking of said residual oil whereby a first volatile hydrocarbon fraction and a first non-volatile residue are produced, (b) contacting the first non-volatile residue with superheated steam under conditions effective to substantially prevent coking of any remaining residual oil and to provide a second volatile hydrocarbon fraction and a second non-volatile residue comprising 1150° F.+residual oil, metals from said residual oil and coal residue, and (c) fractionally distilling the first and second volatile hydrocarbon fractions to provide normally gaseous hydrocarbons, naphtha, gas oil and a bottoms product having a metals content substantially lower than the residual oil.

A second embodiment of this invention is described as a process for the volatilization and solubilization of coal and the demetallization of residual oil which comprises:

(a) providing a mixture of coal and metals-containing residual oil at a temperature of about 850° to about 875° F. but below the incipient coking temperature of said residual oil to a processing zone maintained under conditions effective to volatilize and solubilize said coal, demetallize said residual oil and substantially prevent coking of said residual oil whereby a first volatile hydrocarbon fraction and a first non-volatile residue are produced, (b) contacting the first non-volatile residue with superheated steam under conditions effective to substantially prevent coking of any remaining residual oil and to provide a second volatile hydrocarbon fraction and a second non-volatile residue comprising 1150° F.+residual oil, metals from said residual oil and coal residue, and (c) fractionally distilling the first and second volatile hydrocarbon fractions to provide normally gaseous hydrocarbons, naphtha, gas oil and a bottoms product having a metals content substantially lower than the residual oil.

A further embodiment supplements either of the above embodiments with the following additional steps:

(d) oxidizing the second non-volatile residue in a combustion zone, (e) passing water through the combustion zone in indirect heat exchange relationship thereto to provide the superheated stream of step (b) and, (f) removing ash comprising metals from the combustion zone.

An additional and further embodiment involves recovering the metals from the ash after it is removed from the combustion zone.

Embodiments involving the combustion zone concern preheating the coal, the residual oil or mixtures thereof by means of indirect heat exchange in the combustion zone.

BRIEF DESCRIPTION OF THE DRAWINGS

The drawing is a flowplan illustrating an embodiment of the process of the invention.

DESCRIPTION OF THE PREFERRED EMBODIMENTS

The present invention relates to a process for the volatilization and solubilization of coal and the demetallization of residual oil. Briefly this process may be described as subjecting a mixture of coal and residual oil to elevated temperatures to produce a first volatile fraction and a first non-volatile residue, contacting the first residue with high temperature steam to provide an additional volatile fraction and another non-volatile residue, fractionally distilling both volatile fractions to produce the fractions normally obtained from the fractionator of a catalytic cracking unit and burning the remaining non-volatile residue to provide heat for preheating the coal and the residual oil and for preparing superheated steam.

Thus, the process of this invention involves a number of individual steps or operations. In one embodiment the initial operation involves combining coal at an elevated temperature of about 700° F. with a metals containing residual oil at a temperature below its incipient coking temperature, i.e. at about 930° F., in a weight ratio which will provide an intermediate temperature effective to cause two concomitant reactions to take place. In the first, the coal is volatilized and solubililzed and in the second the residual oil is demetallized. In addition, the reaction conditions are such that substantially no coking of the resid takes place. Two products are thus obtained, (1) a volatile fraction produced as a result of the thermal cracking of the resid and the volatilization/solubilization of the coal and (2) a non-volatile residue from both the coal and the residual oil. To obtain more volatile hydrocarbons this non-volatile residue is subjected to steam stripping at a substantially higher temperature than employed in the initial step. Superheated steam at about 1200° F. will cause additional hydrocarbons to be volatilized from the residue which is heated to about 1000°–1050° F. by the steam. This volatile fraction is combined with the volatile fraction from the initial step and both are fractionally distilled to provide gaseous hydrocarbons, naphtha, gas oil and a low metals bottoms fraction. The residue from the steam stripping is utilized as a fuel to provide heat for the process. The residue combustor may be employed in a variety of ways depending on the heat available therein and the heat requirements of the overall process. Thus, water may be turned into superheated steam to serve as stripping steam in the process. Additionally, the coal may be preheated by indirect heat exchange in the combustor. If sufficient heat is available, the residual oil may likewise be preheated here or alternately a slurry of coal and residual oil may be preheated to the process temperature of the initial step in the process.

In summary, the process of this invention generates metal-free distillates by co-processing coal and residual oil whereby the metals contained in the resid are deposited on the solid portion of the coal which remains after the volatilized/solubilized portion of the coal is generated and removed. This process produces a solid fuel which is used to furnish steam and the necessary energy for the process as well as excess steam for general use and power generation.

The present invention permits the integration of coal into a traditional petroleum refinery. Further, the process permits coal to be processed with heavy residual oil at a time when the use of heavier crude oils and the concomitant increase in the availability of residual non-distillate oils makes it economically attractive to identify process configurations that combine the use of coal with heavy resid.

In practicing the process of this invention mixtures of coal and petroleum residual oil are employed. As used herein, the term "coal" is used to designate a normally solid carbonaceous material including all types of coal, such as bituminous coal, semibituminous coal, subbituminous coal, lignite, peat and mixtures thereof.

The petroleum residual oil (also referred to as resid or residua herein) employed in the process of this invention includes heavy mineral oils, whole or topped crude oils, atmospheric tower residua, i.e., boiling above about 700° F. and vacuum tower residua, i.e., boiling above about 1000° F. deasphalted tars and bottoms fractions from catalytic cracking units and other refinery operations. Asphalts, raw creosote oils, high-boiling crude oils, tars, bitumens, tar sand oils, shale oils and the like may also be employed. Such oils will normally contain constituents boiling above 700° F. and will have API gravities in the range of about −5° to about +20° API and Conradson carbon values of about 1% or more. High boiling residual petroleum residues, i.e. 1000° F.+residual oils, are the preferred feedstocks for use in the process of this invention.

Residual oils often contain high levels of metals which can poison petroleum processing catalysts. Metals such as nickel and vanadium are particularly troublesome catalyst poisons. Since the process of the present invention is particularly directed to reducing the metals content of residual oils, it is especially useful in providing low metals content distillates from high metals content residua. Therefore residual oils having metals contents of about 60 to about 6000 ppm (expressed as nickel plus vanadium) may be usefully employed in the present process.

A preferred embodiment of this invention will be described with reference to the drawing. A residual oil, such as a 1050° F.+vacuum pipestill bottoms, is introduced through line 2 into heater 4 which increases the temperature of the resid to about 930° F. which is about the incipient coking temperature of the resid. The heated residua is then introduced into the bottom of riser conversion zone 6. Hot coal at a temperature of about 700° F. passing through coal conduit 8, provided with flow control valve 10, enters the bottom of riser conversion zone 6 for admixture with the residual oil. The oil and coal are provided in a weight ratio to achieve a temperature of about 860° F. for the admixture. The mixture of coal and resid pass upward through riser conversion zone 6 under conversion conditions which are effective to cause a portion of the coal to be volatililized and solubilized by the oil. Simultaneously some of the oil is volatilized and the metals from the resid are deposited on the solid coal residue. However, the temperature and space velocity conditions are such that substantially no coking of the residual oil occurs. The resulting admixture passes upward through the riser and discharges from the upper end of riser conversion zone 6 through horizontally radiating arms 12 which are provided with a curved inner surface and confining sidewalls and which terminate in a downward direction so as to promote a separation of the volatile portion of the admixture from the non-volatile portion. The admixture passes from the radiating arms into the upper portion of vessel 14 in a downward direction which causes the non-volatile residue to pass into the open upper end of stripping chambers 16 positioned beneath each of the downward pointing ends of radiating arms 12. Stripping chamber 16 is provided with a series of downwardly sloping baffle members to provide a tortuous path for downflowing residue countercurrent to upflowing stripping gas. Each stripping chamber is provided with a source of superheated stream which enters the lower portion of the stripping chamber and passes upward through the downwardly cascading non-volatile residue. The superheated steam is introduced through line 18 at a temperature of about 1200° F. which causes the non-volatile residue to be heated to about 1000°-1050° F. causing additional material to be volatilized. This second volatilized hydrocarbon fraction is carried out of the upper end of stripping chamber 16 by the stripping steam. As this point the second volatilized hydrocarbon fraction becomes mixed with the first volatilized hydrocarbon fraction which is discharging from horizontally radial arms 12 and is carried to the upper portion of vessel 14 where the combined volatile fractions pass through cyclone 20 where any solid particles contained therein are removed and pass to the lower portion of vessel 14 through dipleg 22. The combined volatile fractions pass from the cyclone through line 24 and are transferred from vessel 14 by means of line 26 to a conventional fractionating unit 28 where the combined volatile fractions are separated into metal-free product streams such as gas, naphtha, light and heavy gas oil and bottoms. Other distillate fractions can be obtained by the use of additional side stream drawoffs and/or the use of vacuum distillation equipment as is well known in the art.

Returning to the non-volatile residue, it passes from the bottom of stripping chamber 16 after having been stripped with superheated steam and collects in the bottom of vessel 14 together with any solids recovered through dipleg 22. The stripped non-volatile residue comprises 1050° F.+resid, metals from the resid and coal residue. This residue passes from vessel 14 through residue conduit 30 into combustor 32. The residue is directed to the lower portion of the combustor vessel which is separated from the upper portion by combustor riser 34. The combustor riser permits gas to flow from the lower to the upper portion of combustor 32 and is designed to confine a body of coal above a body of the non volatile residue located in the lower portion of the combustor. The non-volatile residue is supported in the combustor on grate 36 positioned above air inlet ports 38. Air is supplied through line 40 to the air inlet ports 38. As the air passes through the body of non-volatile residue it causes the carbon-containing portion of the residue to burn producing high temperature flue gas which passes up through the body of residue, through combustor riser 34 and into the upper portion of combustor 32.

Fresh coal is introduced through line 42 into combustor 32 at a point above where combustor riser 34 is connected to the vertical wall of the combustor. A body of coal collects in the portion of combustor 32 described by the upper sidewalls of the combustor and the upper surface of combustor riser 34 where it is heated to about 700° F. by indirect heat exchange with the high temperature flue gas passing from the burning non-volatile residue up through the combustor riser. As the coal achieves the desired temperature, flow control valve 10 is opened to permit the coal to flow through coal conduit 8 to riser conversion zone 6.

The high temperature flue gas passes through the upper portion of combustor riser 34 and flows past steam coil 44 which is supplied with water by means of line 46. The flue gas produces superheated steam at about 1200° F. in steam coil 44 when it passes in indirect heat exchanger relationship thereto. The superheated steam leaves combustor 32 through line 18 which supplies the steam to stripping chamber 16 located in vessel 14. Any stream not required for stripping may be utilized for general use or power generation on the refinery site by additional supply lines (not shown).

After flowing past the steam coil, the flue gas enters cyclone 48 which removes any entrained solids from the flue gas before it is removed from combustor 32 through conduit 50 and line 52. The solids removed by cyclone 48 are returned to the lower portion of combustor 32 through dipleg 54.

As the non-volatile residue is burned in combustor 32, it is reduced to an ash containing the metals originally present in the residual oil feed. The ash passes through grate 36 where it collects in the bottom of combustor 32. The ash may be removed continuously or periodically through line 56 for disposal. Where economically attractive, the metals in the ash may be removed there-from by any of several metals recovery processes known in the art.

Although it is preferred to separately preheat the coal and the residual oil in a fashion such as that discussed hereinbefore or by similar means known to those skilled in the art, other means of providing the necessary preheat may be employed when practicing the process of the present invention. For example, the coal and residual oil can be mixed together and the admixture passed through the combustor or other suitable heat source in indirect heat exchange relationship thereto to provide the admixture of coal and residual oil at the temperature required to achieve the desired result in the conversion zone employed in the subject process.

In practicing the process of the invention, process conditions must be employed which are effective to produce the desired result in each operation. Thus in the initial conversion zone the operating conditions must be effective to volatilize and solubilize the coal and demetallize the residual oil while substantially preventing the formation of coke from the residual oil. Effective operating conditions for this conversion zone include a temperature of 800°-900° F., preferably 850°-875° F., a weight ratio of coal to oil of about 0.1 to about 1.0, preferably about 0.2 to about 0.4 and a residence time of about 0.5 to about 10 seconds, preferably about 0.5 to about 4 seconds.

The steam stripping is also conducted under conditions which will substantially prevent coking of any residual oil remaining after passage through the conversion and which will cause additional volatile hydrocarbons to be formed. Superheated steam at a temperature of about 1150° to about 1250° F., preferably about 1175°-1225° F., most preferably about 1200° F. will be effective. The strippers should be designed to provide intimate contact between the steam and the non-volatile residue as they pass in countercurrent relationship. Assuming effective contact is obtained, residence times of about 10 to about 45 seconds, preferably about 15 to about 30 seconds in the stripper should prove adequate. Temperatures in the steam stripping zone will generally be about 1000°-1100° F., preferably 1025°-1075° F.

The operating parameters employed when fractionating the combined volatile fractions are those conventionally employed in petroleum distillation units, are therefore well known to those skilled in the art and need not be enumerated here.

The operation of the combustor is not critical. Therefore the quantity of air will be dependent on the quantity and quality of the residue to be burned as well as the process requirements for superheated steam and coal preheat and the particular design employed for the combustor and its attendant equipment. Those skilled in the art are familiar with the effective operation of such a processing unit.

What is claimed is:

1. A process for the volatilization and solubilization of coal and the demetallization of residual oil which comprises:

providing coal at a temperature of about 650° to about 750° F. and a metals containing residual oil at a temperature of about 900° to about 950° F. but below the incipient coking temperature of said residual oil to a processing zone maintained under conditions effective to volatilize and solubilize said coal, demetallize said residual oil and substantially prevent coking of said residual oil whereby a first volatile hydrocarbon fraction and a first non-volatile residue are produced, separating volatilized hydrocarbon from said first non-volatile residue, contacting the first non-volatile residue with superheated steam at a temperature of about 1150° F. to 1250° F. under stripping conditions effective to substantially prevent coking of any remaining residual oil and to provide a second volatile hydrocarbon fraction and a second non-volatile residue comprising 1150° F.+residual oil, metals from said residual oil and coal residue, and fractionally distilling the first and second volatile hydrocarbon fractions to provide normally gaseous hydrocarbons, naphtha, gas oil and a bottoms product having a metals content substantially lower than the residual oil.

2. A process according to claim 1 including the following additional steps:

oxidizing the second non-volatile residue in a combustion zone, passing water through the combustion zone in indirect heat exchange relationship thereto to provide the superheated stem and, removing ash comprising metals from the combustion zone.

3. A process for the volatilization and solubilization of coal and the demetallization of residual oil which comprises:

(a) providing a mixture of coal and metals-containing residual oil at a temperature of about 850° to about 875° F. but below the incipient coking temperature of said residual oil to a processing zone maintained under conditions effective to volatilize and solubilize said coal, demetallize said residual oil and substantially prevent coking of said residual oil whereby a first volatile hydrocarbon fraction and a first non-volatile residue are produced, (b) removing volatilized hydrocarbon produced in step (a) from the first non-volatile residue and contacting the first non-volatile residue with steam superheated to a temperature of about 1150° F. to 1250° F. under stripping conditions effective to substantially prevent coking of any remaining residual oil and to provide a second volatile hydrocarbon fraction and a second non-volatile residue comprising residual oil, metals from said residual oil and coal residue, and (c) fractionally distilling the first and second volatile hydrocarbon fractions to provide normally gaseous hydrocarbons, naphtha, gas oil and a bottoms product having a metals content substantially lower than the residual oil.

4. A process according to claim 3 including the following additional steps:

(d) oxidizing the second non-volatile residue in a combustion zone, (e) passing water through the combustion zone in indirect heat exchange relationship thereto to provide the superheated steam of step (b) and, (f) removing ash comprising metals from the combustion zone.

5. A process according to claim 4, including the following additional step:

(g) recovering the metals from the ash of step (f).

6. A process according to claim 3 wherein the weight ratio of coal to oil in step (a) is between about 0.1 to about 1.0.

7. A process according to claim 3 wherein the processing zone conditions of step (a) include a temperature of about 825°–875° F.

8. A process according to claim 3 wherein the superheated steam of step (b) is at a temperature of about 1175° F. to about 1225° F. and the effective conditions of step (b) include a temperature of about 1000° to about 1100° F.

9. A process according to claim 4, including the following additional step:

(h) passing fresh coal through the combustion zone in indirect heat exchange relationship thereto to provide the coal of step (a) at a temperature of about 650° to about 750° F.

10. A process according to claim 4, including the following additional step:

(i) passing a metals-containing residual oil through the combustion zone in indirect heat exchange relationship thereto to provide the residual oil of step (a) at a temperature of about 900° to about 950° F. but below the incipient coking temperature of said residual oil.

11. A process according to claim 4 including the following additional step:

(j) passing a mixture of coal and residual oil through the combustion zone in indirect heat exchange relationship thereto to provide the mixture of coal and residual oil of step (a) at a temperature of about 850° to about 875° F. but below the incipient coking temperature of said residual oil.

12. A process according to claim 3 wherein the residual oil of step (a) is a 1000° F.+residual oil.

13. A process according to claim 3 wherein the residual oil of step (a) has a metals content of about 60 to about 6000 ppm (expressed as nickel plus vanadium).

* * * * *